US005605466A

United States Patent [19]

Devlin et al.

[11] Patent Number: 5,605,466

[45] Date of Patent: Feb. 25, 1997

[54] WALL OUTLET ADAPTER HAVING SAWTOOTH PROFILE

[75] Inventors: Thomas E. Devlin, Brighton; Karl T. Ulrich, Cambridge, both of Mass.; George Favaloro, Houston, Tex.

[73] Assignee: New Vector Products, Inc., Cambridge, Mass.

[21] Appl. No.: 371,950

[22] Filed: Jan. 12, 1995

[51] Int. Cl.[6] ..... H01R 13/44

[52] U.S. Cl. ..... 439/144; 439/954

[58] Field of Search ..... 439/142, 144, 439/954, 652

[56] References Cited

U.S. PATENT DOCUMENTS

| | | | |
|---|---|---|---|
| D. 233,729 | 11/1974 | De Forrest | D8/179 |
| 904,898 | 11/1908 | Russell | D8/179 |
| 3,005,179 | 10/1961 | Holt | 439/652 |
| 3,156,515 | 11/1964 | More | 439/652 |
| 3,341,268 | 9/1967 | Bickford | 312/100 |
| 3,997,225 | 12/1976 | Horwinski | 439/105 |
| 4,197,959 | 4/1980 | Kramer | 439/142 |
| 4,874,906 | 10/1989 | Shotey | 439/144 |
| 4,915,638 | 4/1990 | Domian | 439/142 |
| 4,934,962 | 6/1990 | Luu et al. | 439/651 |
| 4,993,963 | 2/1991 | Pedigo | 439/142 |
| 5,004,435 | 4/1991 | Jammet | 439/652 |
| 5,045,640 | 9/1991 | Riceman | 174/67 |
| 5,124,506 | 6/1992 | Briggs et al. | 439/142 |
| 5,129,842 | 7/1992 | Morgan et al. | 439/540.1 |
| 5,196,988 | 3/1993 | Horn | 361/362 |
| 5,218,169 | 6/1991 | Riceman | 174/67 |
| 5,269,695 | 12/1993 | Opel | 439/107 |
| 5,280,135 | 1/1994 | Berlin et al. | 174/67 |
| 5,281,172 | 1/1994 | Luu | 439/651 |
| 5,295,869 | 3/1994 | Siemon et al. | 439/620 |
| 5,317,108 | 5/1994 | Prairie, Jr. | 174/67 |

FOREIGN PATENT DOCUMENTS

| | | | |
|---|---|---|---|
| 282332 | 9/1990 | Germany | 439/502 |

OTHER PUBLICATIONS

Woods Industries Brochure.

*Primary Examiner*—Neil Abrams
*Assistant Examiner*—Barry Matthew L. Standig
*Attorney, Agent, or Firm*—Steven J. Weissburg

[57] ABSTRACT

An electrical outlet adapter has a base that has a support face and a room face. The support face has a cord end, an oppositely disposed nose end and two sides. The room face is spaced from the support face and comprises a cord end socket surface and a nose end socket surface, spaced from each other and substantially parallel, each socket surface forms an angle with the support face of between 90° and 135°. A medial surface connects the cord end socket surface with an adjacent socket surface relatively noseward. Piercing each socket surface is at least one set of socket holes adapted to receive a multi-prong electrical power plug. Adjacent each set of socket holes is an electrical conductor configured to mate with the multi-prong electrical power plug when inserted into the set of holes. Connected to each of the electrical conductors, is an electrical network that is configured as a multi-prong electrical power plug. The adapter may also have a cover. The cover comprises a main plate that extends over an area substantially at least as large as the medial surface of the base and means for attaching the main plate to the base, movably between a closed position and an open position. In the closed position, an opening is defined between the cord end of said cover and the shell to accommodate the passage of electrical cords therethrough.

24 Claims, 5 Drawing Sheets

WALL OUTLET ADAPTER HAVING SAWTOOTH PROFILE

BACKGROUND

This invention relates to electrical connection devices, and more particularly to an electrical outlet adapter (also referred to as a current tap).

With the ever increasing number of electrical devices, there is a growing need for more electrical sockets than are normally available from the permanent wall outlets installed in a home or office.

Most permanent wall outlets are of a duplex type in that they contain two sockets. Many outlet adapters are available for increasing the number of available sockets from a permanent wall outlet. These outlet adapters typically consist of at least one two or three-pronged plug and two or more sockets. When the tap is plugged into a permanent wall outlet, it effectively increases the number of available sockets. Some of these outlet adapters are provided with a mounting screw that allows them to be semi-permanently installed to a duplex outlet. The number of sockets available from existing outlet adapters generally ranges from two to six.

When numerous cords are connected to an outlet adapter, these cords may emerge from the outlet adapter in many different directions and may become twisted and tangled. The resulting arrangement of the outlet adapter and connected cords is unsightly. The problem of unsightliness is especially acute in homes and offices where outlets are exposed to view, such as in kitchens or living rooms. In kitchens, the outlets are often high off the floor, above counter tops and clearly in view.

The cords and outlet adapter also frequently extend a large distance perpendicular from the surface in which the permanent outlet is installed, creating an obstruction for furniture and reducing the free space around the outlet available for activity or storage.

When outlet adapters are installed in certain locations, such as kitchens, where they are exposed to dust, dirt, or sprayed matter, they can become dirty and are difficult to clean. When the outlet adapter is exposed to sprayed or splashed liquids, an electrical hazard may also arise.

Cords attached to existing outlet adapters are not stable mechanically and are easily dislodged. This problem is especially present in areas, such as kitchens, where there is a great deal of activity in the immediate vicinity of the outlets. The plugs can be pulled out entirely from the outlet adapter, or partially, leaving the sockets and associated metal conductors exposed to liquids and small children.

Existing outlet adapters allow easy access to the sockets by young children, posing an electric shock hazard.

When an outlet adapter consists of one or more sockets that do not directly face the user (who is often above the level at which the tap is installed), the user confronts the frustrating task of trying to orient the plug such that it can be inserted into the socket. Generally either the user must make multiple attempts to insert the plug, use fingers to estimate the orientation, or the user must stoop or crane to see the socket in order to guide the insertion of the plug successfully.

It is known for outlet adapters to insert into a conventional wall outlet and employ a plurality of sockets oriented such that the plug is inserted along, or parallel, to the wall, rather than perpendicular to it. The intent is to minimize the distance that plugs and power cords protrude into the room. These devices leave the cords disarranged, in an aesthetically unpleasing manner and do not allow the cords to exit in an orderly fashion and in the same direction.

Many safety guards prevent young children from tampering with electrical receptacles. These are limited in appeal because they are visually bulky and do not accommodate any more than two plugs per duplex outlet. Further, they typically require removal of the wall plate for installation.

Also known are hinged box-like covers for existing permanently installed receptacles, but these and similar devices do not accommodate outlet adapters and do not increase the number of sockets available for use.

Accordingly, for the foregoing reasons, there is a need for an improved outlet adapter that: accommodates multiple cords in an attractive fashion; minimizes the size and protrusion of the cords and adapter; protects the sockets from contamination and liquid entry; prevents inadvertent dislodging of the plugs; protects young children from the hazards of electric shock; minimizes the dimensions parallel to the support surface for an increased number of sockets; and facilitates the orientation and insertion of plugs.

SUMMARY

The adapter according to the invention consists of a base and a cover. The base attaches to a permanent wall outlet by means of at least one plug and one mounting screw. The base consists of a plurality of rows of sockets in which the axis of insertion of the sockets is angled in one direction, generally not perpendicular to the support wall and typically downward when used with an outlet installed in a vertical wall. This arrangement causes the cords to exit the tap in the same direction, typically downward, and in an organized fashion. The cover is hingedly attached to the base with the pivot distal from the direction of the cord exit. The cover has a front, two sides, and a bottom, with one or more openings in the bottom to allow the passage of cords. The cover can be latched into one closed and at least one open position. The cover may also be secured in the closed position by means of a screw or other locking means.

A preferred embodiment of the invention is an electrical outlet adapter having a base. The base comprises a shell, having a support face and a room face. The support face has a substantially planar, annular perimeter having a cord end, an oppositely disposed nose end and two sides, each connecting the cord end to the nose end. The room face is spaced away from the support face and generally coextensive therewith. It comprises a cord end socket surface and a nose end socket surface, spaced from each other and substantially parallel, each socket surface having a room edge and a support edge and forming an angle with the support face of between 90° and 135° as measured from the cord end of said support face. A medial surface connects the room edge of the cord end socket surface with the support edge of an adjacent socket surface relatively noseward, which may be the nose end socket surface, or an additional socket surface. Piercing each socket surface is at least one set of socket holes adapted to receive a multi-prong electrical power plug. The base also includes a first side that joins the room face to a first side of the support face and a second side that joins the room face to the second side of the support face. Adjacent each set of socket holes, between the socket holes and the support face, is an electrical conductor configured to mate with the multi-prong electrical power plug when inserted into the set of holes. Connected to each of the electrical conductors, is an electrical network that extends beyond the support face away from the room face and is configured as a multi-prong electrical power plug.

Another preferred embodiment of the invention is an adapter having a base, as described immediately above, accompanied by a cover. The cover comprises a main plate that extends over an area substantially at least as large as the medial surface of the base. The main plate comprises a cord end, a nose end and two side edges, each connecting the cord end to the nose end. The cover also has means for attaching the main plate to the base, movably between a closed position and an open position, wherein in the closed position, an opening is defined between the cord end of said cover and the shell to accommodate the passage of electrical cords therethrough.

In another preferred embodiment of the invention, the cover has a pair of oppositely disposed side plates, each extending substantially from the cord end to the nose end of the main plate and attached to a side edge thereof, each sized and arranged to substantially cover a respective shell side when the cover is in the closed position.

The cover of the invention may also include a cord end plate, attached to the main plate at the cord end, sized and arranged to generally close off the opening between the cord end of the cover and the shell, except for an opening sized to accommodate the passage of at least one electrical cord therethrough.

The invention may also include in another preferred embodiment, on the medial surface of the base, adjacent at least one of the sets of socket holes, an indicia, (visual or tactile) of the location and orientation of the socket holes.

The socket holes can be adapted to receive two-prong or three-prong plugs. In particular, the nose end socket surface may be adapted to receive only three prong plugs, with the cord end socket surface being adapted to receive three and/or two prong plugs.

In other preferred embodiments of the invention, the socket holes in the cord end socket surface are staggered relative to the socket holes in the nose end and other socket surfaces.

Another preferred embodiment of the invention includes a means for latching the cover in a closed position to the base. This latch can be a quarter-turn latch, or a screw, or other suitable means.

In yet another preferred embodiment of the invention, the cover is hingedly attached to the base near to the nose end of the adapter. This embodiment may also include means for securing the cover in a hingedly open position, such as a protrusion that secures the cover open frictionally.

BRIEF DESCRIPTION OF THE DRAWINGS

These and other features, aspects, and advantages of the present invention will become better understood with regard to the following description, appended claims and accompanying drawings, where:

DETAILED DESCRIPTION

Figure 1:
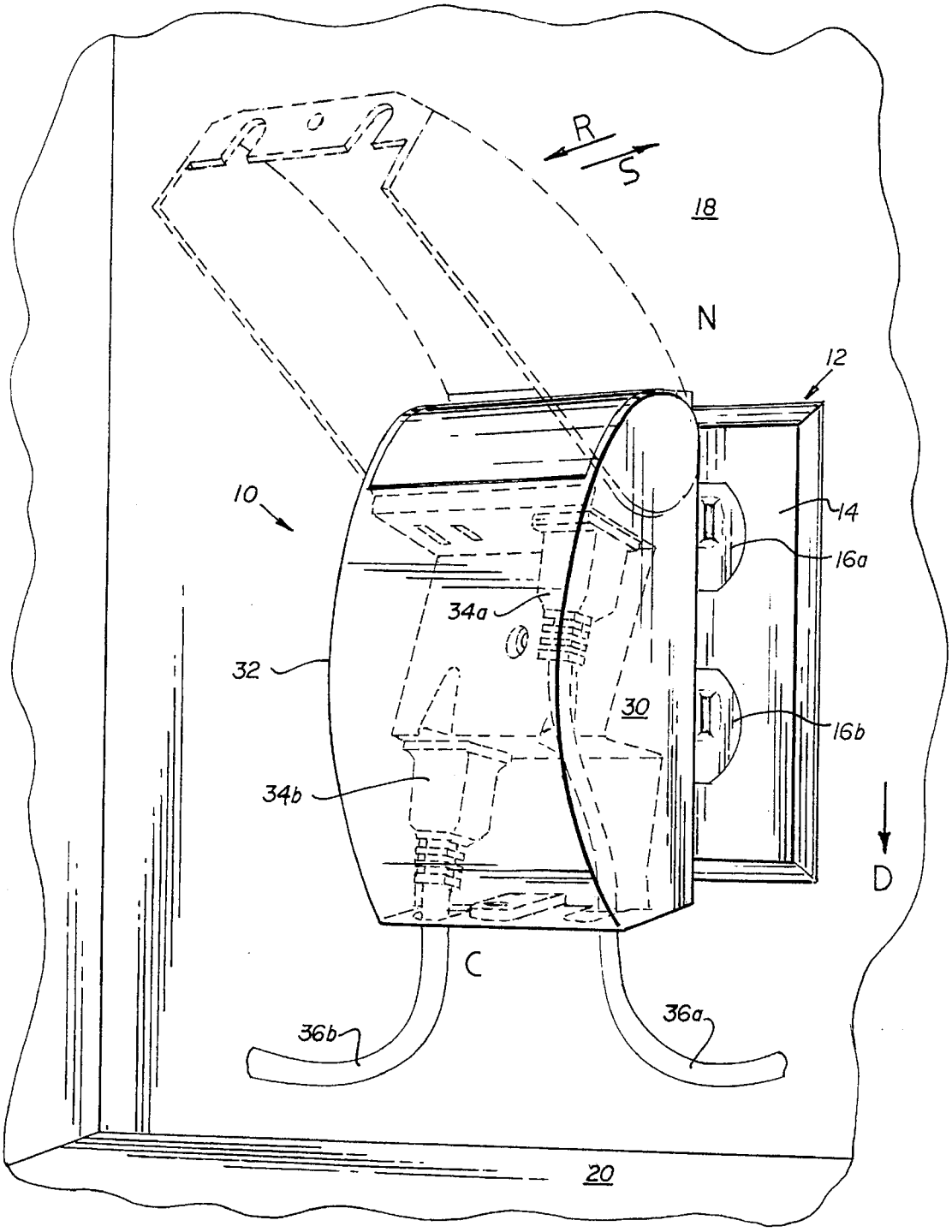
FIG. 1 is a perspective view of a preferred embodiment of an outlet adapter with cover, constructed according to the present invention, also showing the cover in an open position, in phantom.

A preferred embodiment of the present invention is a covered outlet adapter 10 (also referred to as a current tap), as shown in perspective in FIG. 1. In general, such adapters are plugged into a duplex wall outlet 12 having a wall outlet plate 14 and a pair of wall outlet sockets 16*a* and 16*b*. The wall outlet 12 is generally fixed in a vertical wall 18, with the downward direction being indicated by the arrow D. Often the outlet is near a horizontal surface 20, which may be a floor or a counter top, for instance, in a kitchen. Less frequently, the outlet is located on a horizontal surface, either an upper surface, exposed to the user, (such as in the floor of a large room where power is desired to be provided to locations distant from the walls) or on a lower surface, (such as under a work bench or stereo cabinet). The vertical orientation is most frequent however, and it will be assumed for purposes of simplifying discussion only, that the outlet is so oriented. However, the invention is not limited to such uses.

The outlet adapter 10 includes a base 30 (shown in phantom) and a cover 32, shown closed, and shown open in phantom. Also shown are two plugs 34*a* and 34*b*, each connected to an appliance by a respective electrical cord 36*a* and 36*b*. (For purposes of reference, the "cord" end of the apparatus and its components is the end toward which the cords exit, as shown in FIG. 1, designated "C". Further, the "nose" end is the opposite end of the apparatus, most distant from the cord end, designated "N." The support direction of the apparatus, indicated by the arrow S, is the direction toward the support surface in which the wall outlet 12 is mounted, for instance the wall 18. The "room" direction, indicated by the arrow R is the opposite direction from the support direction). (The term "nose" has been chosen relatively arbitrarily,, to designate the non-cord end. There is no requirement that this end of the apparatus resemble in any way a nose of any sort. )

The cover 32 (referring to FIG. 2A) is shell-like, consisting of a main plate 40, two side plates 42*a* and 42*b*, and a cord end plate 46. The main plate 40 is approximately rectangular and is slightly convex toward the room. The side plates 42*a* and 42*b* are mirror images of each other. Each side plate 42*a*, 42*b*, is attached along a majority of the length of a room ward edge 44*a*, 44*b* to the edges of the main plate 40, with an extending section 48*a*, 48*b* of each side extending beyond the length of the main plate near the nose end. The extending side plate end 48*a*, 48*b* is approximately semicircular in shape.

On the inner face of each side plate 42, in the extending section 48, there is a protruding hinge stub 50*a*, 50*b*. These stubs mate with the hinge holes 52*a* (not shown) and 52*b* in the base 30, to form a hinged attachment of the cover 32 to the base 30. Preferably, the holes are blind holes, to prevent insertion of a small finger into the hole if the cover has been removed completely. (In an alternative embodiment, the hinge stubs could be carried by the base 30 and the holes could be part of the cover 32.)

Located generally between the hinge stubs 50*a*, 50*b* and the support-ward edge of the side plates 48*a*, 48*b*, on the inside face of each side plate 48*a*, 48*b*, are generally rectangular closure recesses 54*a* and 54*b*. Each of these closure recesses engage with an opening-position protrusion 60*b* (60*a* not shown) when the cover 32 is in the closed position. When the cover 32 is in an open position, the disengaged opening-position protrusions 60*a* and 60*b* cause a flexion of the extending side plates 48*b* and 48*a*, which in turn gives rise to a friction force between the cover 32 and the base 30, such that the cover will remain in any non-closed position to which it is moved. Thus, the opening-position protrusion and the cover cooperate to hold the cover open in any position desired.

One open position is shown in FIG. 1, in phantom, with the closed position being shown in solid line. Each cover side plate 42 also includes a closing protrusion 62*a*, 62*b*, near its free edge near the cord end of the cover 32. This closing protrusion 62*a*, 62*b*, engages with a closing recess 64*b* (64*a* not shown) in the base as an additional latch mechanism to secure the cover in the closed position.

The cord end plate 46 of the cover 32 is attached to the main plate 40 and to the two side plates 42*a*, 42*b* along three of its sides. The cord end plate 46 includes two cord slots 66 that extend from the free edge 68 of the cord end plate 46 toward the main plate 40.

The cord end plate 46 also includes a cover latch hole 70 located approximately midway between the two side plates 42*a*, 42*b*. This cover latch hole 70 is aligned with a base latch hole 72, supported on a base latch tab 74, when the cover 32 is closed. A base locking screw 76 may be inserted through the cover latch hole 70 and the base latch hole 72 to secure the cover 32 in the closed position. By locating the base latch hole 72 a significant distance from the support surface, screwdriver access can be had to engage and disengage the screw 76 while the apparatus is mounted to the support surface.

The base 30 also consists of a base shell 80 (shown more clearly in FIGS. 2B, 2C and 2D), a support plate 82, and electrical conductors 84. The support face 86 of the base shell 80 is the side that mates with the support plate 82. The support face 86 of the base shell 80 is approximately rectangular in plan view, having a cord end 88, a nose end 90 and two side edges 92*a* and 92*b*. The base shell 80 also consists of a room face 94 and two sides 96*a* and 96*b*.

Figure 2A:
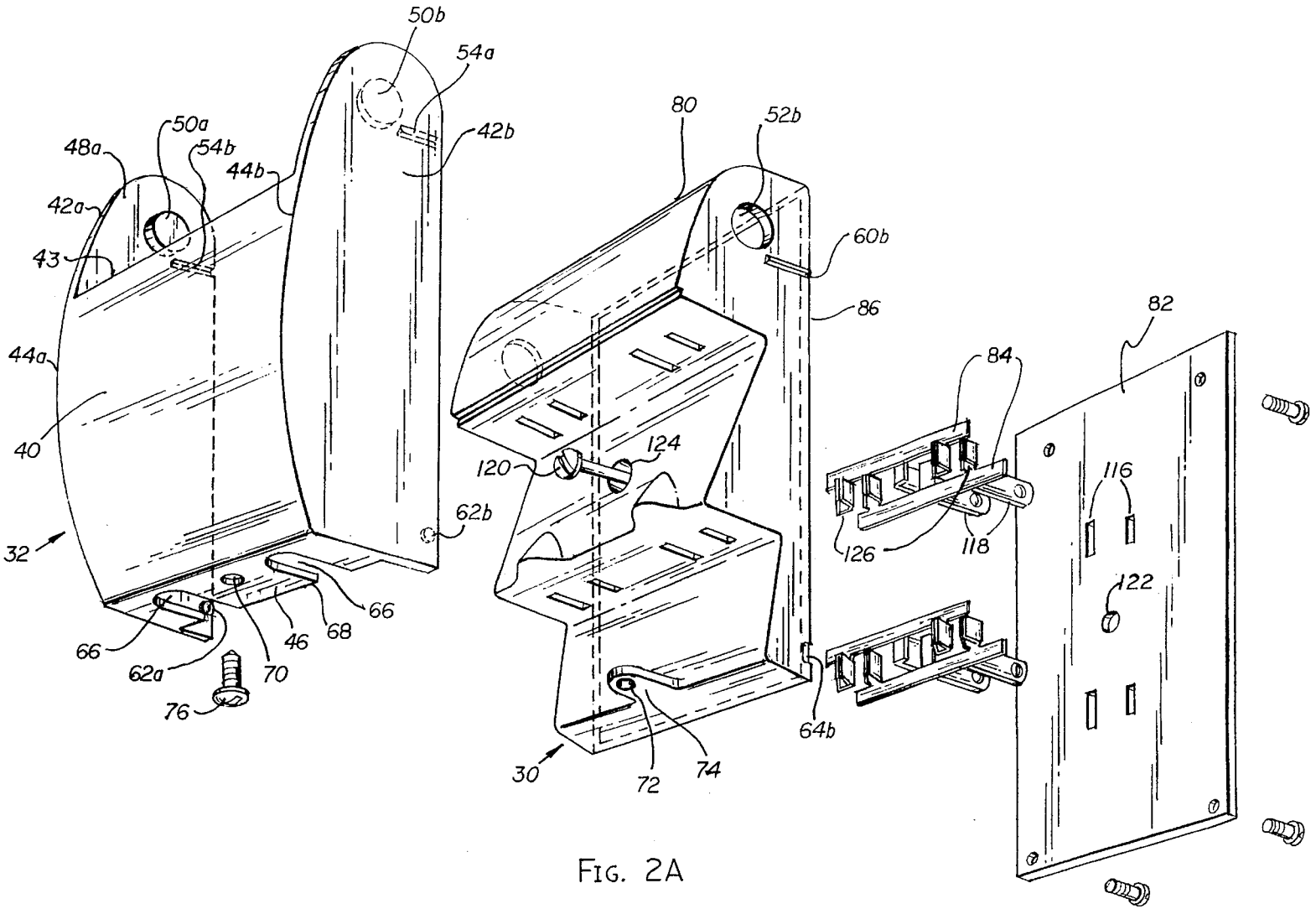
FIG. 2A is an exploded view of the outlet adapter shown in FIG. 1.
Figure 2B:
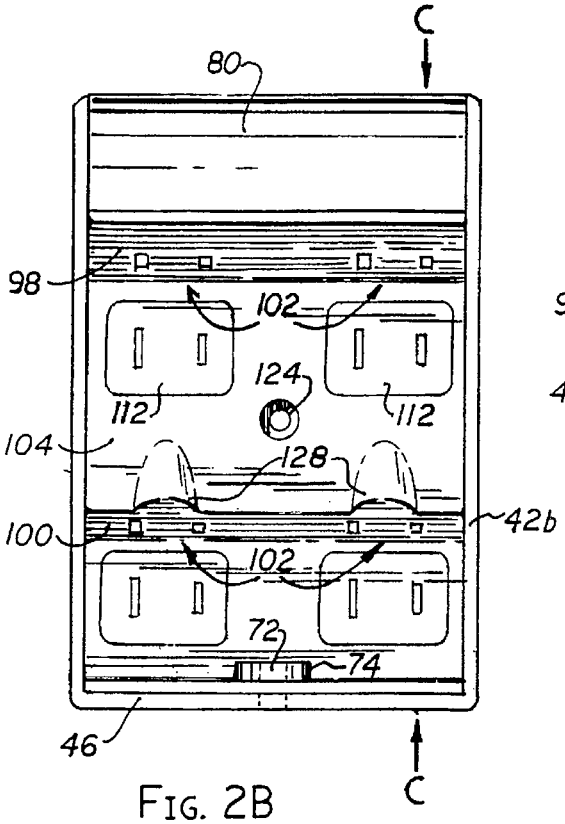
FIG. 2B is a front elevation view of the outlet adapter shown in FIG. 1, with the cover, shown as transparent, in a closed position.
Figure 2C:
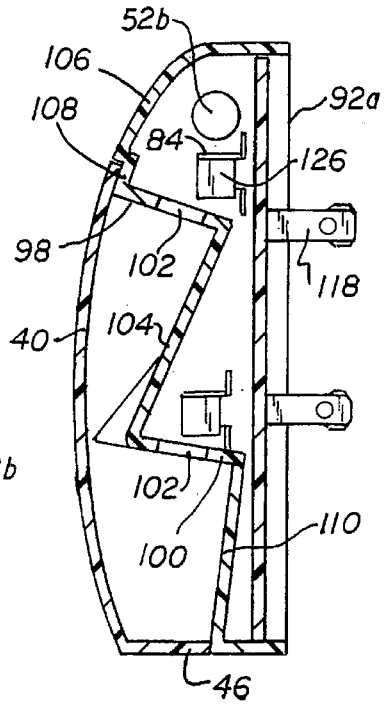
FIG. 2C is a side cross-section view of the outlet adapter shown in FIG. 2B, through the lines C—C, with some elements removed for clarity.
Figure 2D:
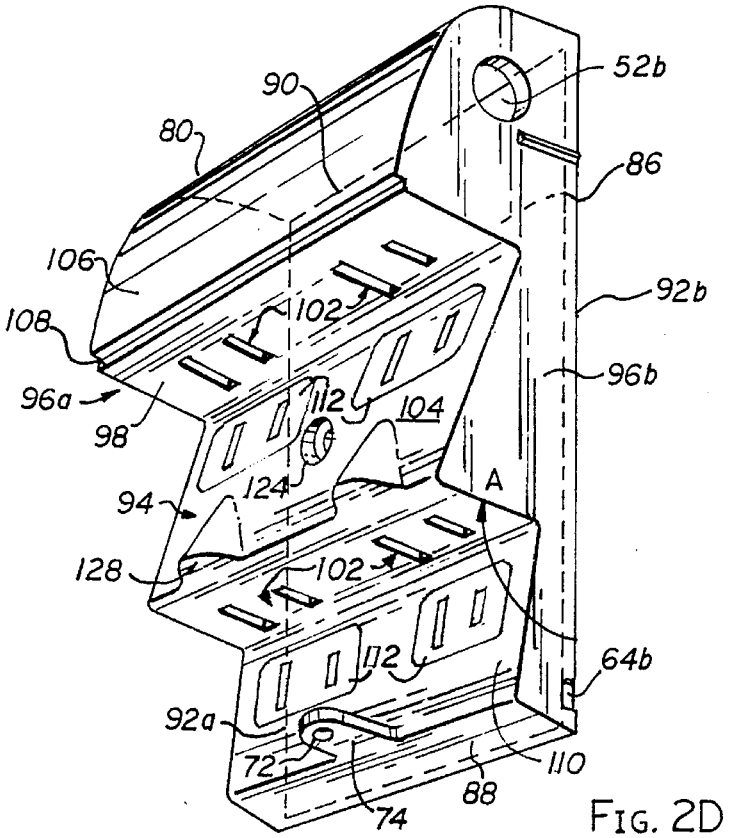
FIG. 2D is a perspective view of the base portion only of the outlet adapter shown in FIG. 1.

The room face 94 includes two socket surfaces 98 and 100, which are substantially parallel to each other (having an included angle of between 0° and 10°) and oriented at a slightly obtuse angle to the support face 86, as measured from the cord end, indicated by angle A in FIG. 2D. Each of these socket surfaces, in the embodiment shown, contains two sets of openings 102 configured to form sockets to accommodate electrical plugs. The two socket surfaces 100 and 98, one near to the cord end and one near to the nose end of the base shell, face in approximately the same direction and extend from the support face 86 approximately the same distance. The two socket surfaces are spaced from each other such that they divide the base shell room face 94 into three sections of approximately equal size. The two socket surfaces are connected to each other by a medial surface 104, extending from the roomward edge of the cord end socket surface 100 to the support-ward edge of the adjacent socket surface 98. The medial surface and the two socket surfaces form a sawtooth pattern when viewed from the side, for instance as shown in FIG. 2C or 2D (in perspective).

The nose end section 106 of the base shell connecting the roomward edge of the nose end socket surface 98 to the support face 86 of the base shell is curved to match the curvature of the extensions 48 of the sides 42 of the cover 32. At the line of intersection of this nose end section 106 and the nose-ward socket surface 98, there is a shoulder 108 that mates with the free nose edge 43 of the main plate 40 of the cover 32.

The cord end section 110 of the room face 94 of the base shell 80 connects the support-ward edge of the cord end socket surface 100 to the support face 86 of the base shell 80. It may be approximately parallel to the support face 86 of the base shell, or approximately parallel to the medial surface 104, or oriented at any angle in between these two orientations. It follows a radius and turns ninety degrees to connect to the support surface of the base shell.

A base latch tab 74 for the base latch hole 72 extends roomward from the room face of the base shell, generally perpendicular to the support face 86. On the surface of the room face adjacent to each set of socket openings 102, there is an iconic representation 112 of a set of socket holes, consisting of a raised rectangular region with two depressed stripes. These stripes are approximately the same length as the openings in the socket surface with which they are aligned. Conventionally, in a two prong plug, one of the prongs has a longer cross-section than the other, to force insertion into the socket in only one orientation.

The icons indicate not only the position of the socket, but also the orientation, both of which are difficult to determine in many circumstances.

The two sides 96*a*, 96*b*, of the base shell 80 are approximately perpendicular to the support surface 86 of the base shell and connect to the room face 94 of the base shell along an edge 114 with a sawtooth shape, as viewed from the side. Each side 96 contains a hinge hole 52 that mates with the hinge stub 50 in the sides of the cover. This hole 52 is located at the end of the shell distal from the cord end.

Each side also contains a closure recess 60*b* along the support face edge of the base shell 80 to mate with the opening-position protrusions 54*a* and 54*b* in the cover 32. Each side also contains another recess on the support face edge of the base shell near the end of the shell containing the base latching hole 72.

The support plate 82 is rectangular in outline. It includes holes 116 for the passage of the conductor prongs 118 beyond the plane of the support plate. The conductor prongs 118 are connected to the conductors 84. A mounting hole is also provided in the support plate for the mounting screw 120, and holes are also provided for the four support plate screws. The support plate mates with a recess in the base shell such that the support plate is depressed a small distance from the support face of the base shell 80.

The base shell includes a mounting hole 124, positioned at approximately the center of the rectangle formed by the support plate of the shell, that extends completely through the shell and support plate. A mounting screw 120 extends through this hole.

The electrical conductors (for a four socket (two prongs for each socket) embodiment of the invention) consist of four separate conductive elements 84. Each element 84 contains a prong 118 that passes through the support plate 82 and protrudes beyond the plane of the support plate. These prongs 118 form two standard plug configurations which mate with a standard duplex wall outlet. Each conductive element 84 also contains a v-shaped feature 126 that makes electrical contact with the prong of a plug inserted through the sockets 102 in the base shell.

The guards 128 are located to prevent insertion of a three prong plug into a two prong socket, as configured in the embodiment shown in FIG. 2D.

Thus, the embodiment shown accomplishes the objects of the invention. Additional sockets are provided to enlarge the number of sockets available from a duplex wall outlet. The profile of the apparatus in a direction perpendicular to the support is minimized, due to the generally cord-ward angling of the socket surfaces facilitated by the saw-tooth arrangement. In normal use, these surfaces would be facing generally downward. The profile is minimized, because the long dimension of the plug, along its long axis, is aligned parallel with the support surface, rather than perpendicular to it. The cords of the appliances are all guided generally downward, and gathered by the cord slots 66 in the cord end plate 46. The adapter is securely attached to the support wall by the mounting screw 120. The plugs are protected against accidental dislodgment due to their orientation and the cover. The cover 32 is conveniently latchable against child tampering, but is easily unlatched by an adult. The cover may also be temporarily held open using the opening protrusions and recesses.

The shoulder between the cover 32 and the base shell 30, which allows the cover to overlap the base shell a small bit prevents splashed liquid from entering near to the sockets.

The embodiment shown in FIGS. 1 and 2A have two socket support surfaces, each carrying two sockets. There may be more support surfaces than two, and each surface may carry one, two or more sockets.

Figure 3:
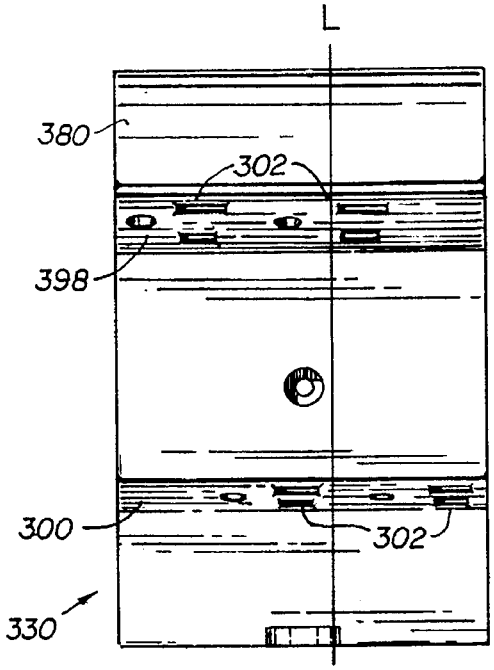
FIG. 3 is a front elevation view of another preferred embodiment of the base of the outlet adapter of the invention, having a staggered placement of sockets.

Another preferred embodiment of the base of the invention is shown in FIG. 3. It consists of four, three-prong sockets 302 instead of the two-prong sockets 102 that are shown in FIGS. 2A–2D. The two sockets 302 in the nose-ward socket surface 398 are positioned in a staggered fashion relative to the sockets in the cord-ward socket surface 300. This is indicated by the line L, which is generally perpendicular to both the nose end and the cord end of the support surface. The line L passes through the center of the socket openings that make up the socket 302 in the nose-ward socket surface 398, but pass outside of the socket openings that make up the socket 302 in the cord-ward socket surface 300. The staggered configuration helps to minimize the side-to-side dimension of the adapter (parallel to the support surface, and perpendicular to the nose-to-cord-end dimension), while still allowing finger access to a plug relative to adjacent installed plugs.

Figure 4A:
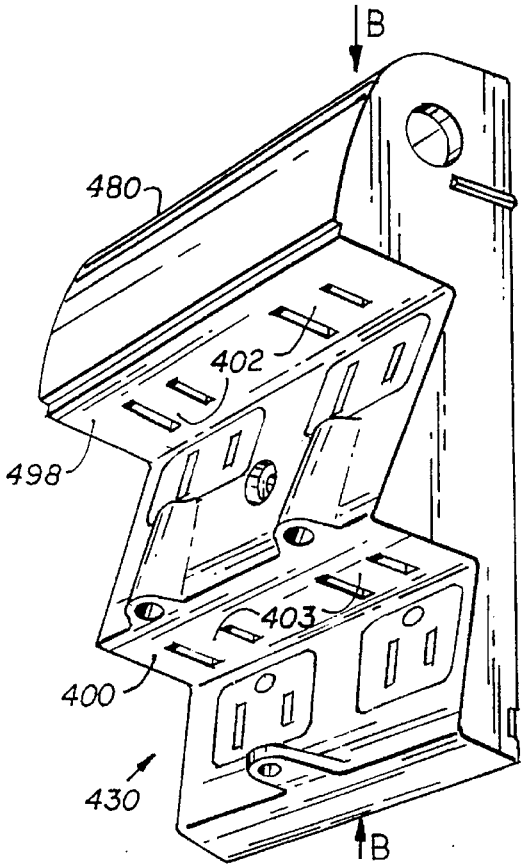
FIG. 4A is a perspective view of another preferred embodiment of the base of the outlet adapter of the invention, having orientation icons and one set of three-prong accepting sockets and one set of two-prong accepting sockets.
Figure 4B:
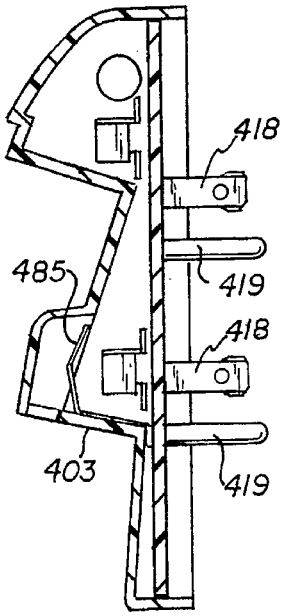
FIG. 4B is a side cross-sectional view along the lines C—C of the outlet adapter base shown in FIG. 4A.

Another preferred embodiment of the base of the invention is shown in FIGS. 4A and 4B. It has the cord-ward socket surface 400 with three-prong sockets 403 and the nose-ward socket surface 498 with two-prong sockets 402. This configuration minimizes the depth of the adapter putting the larger three prong sockets closer to the support wall. The three prong socket requires an additional prong 419, as shown in the side view cross-section of FIG. 4B and an additional conducting element 485. The size of the nose-ward socket surface 498, which carries only two prong sockets, must extend far enough such that a three prong plug cannot be inserted into the sockets.

Figure 5:
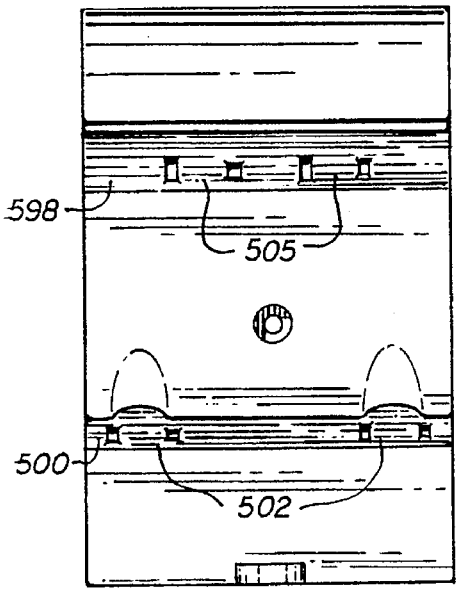
FIG. 5 is a front elevation view of yet another preferred embodiment of the base of the outlet adapter of the invention, having inward and outward staggered sockets.

Another preferred embodiment of the base of the invention is shown in FIG. 5. It has outboard sockets 502 that are positioned such that the sockets 502 in the cord-ward socket surface 500 are both near the outer edge of the base, while the inboard sockets 505 on the nose-ward socket surface 598 are positioned near the middle of the base (as measured from side-to-side).

Figure 6:
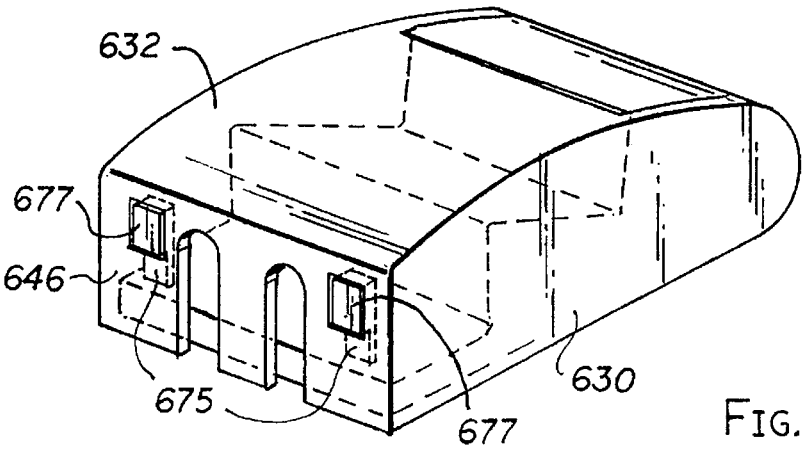
FIG. 6 is a perspective view of another preferred embodiment of the cover locking mechanism of the invention, having a pair of tabs and mating receptacles at the cord-end of the cover.

Another preferred embodiment of the outlet adapter is shown in FIG. 6 (with the cover shown as transparent). This embodiment has two tabs 675 extending generally perpendicular from the base shell 630. These two tabs 675 mate with two tab recesses 677 in the inside of the cord end plate 646 of the cover 632 when the cover 632 is in the closed position.

Figure 7:
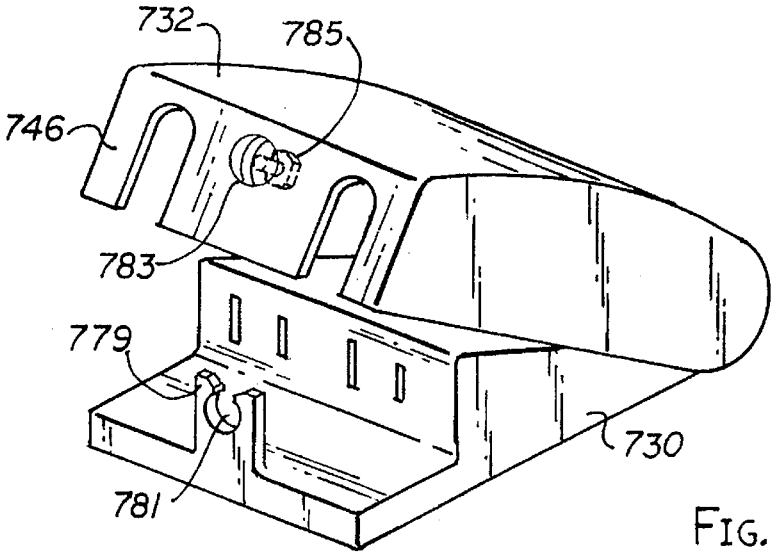
FIG. 7 is a perspective view of still another preferred embodiment of the cover locking mechanism of the invention having a quarter-turn latch at the cord-end of the cover.

Another embodiment of the outlet adapter, shown in FIG. 7 (again with the cover shown as transparent), has a quarter-turn fastener permanently captured in a hole in the cord end plate 746 of the cover 732. (Being permanently captured, the fastener cannot easily be lost.) This fastener consists of a head 783 and a key 785. The key 785 is approximately rectangular in shape. When the fastener is oriented in the unlocked position, the key 785 fits through the narrow neck in the fastener slot 781 in the tab 779 extending from the base shell 730. When the fastener is turned 90 degrees, the key 785 does not pass through the narrow neck and is thus retained in the circular region of the fastener slot 781.

Figure 8:
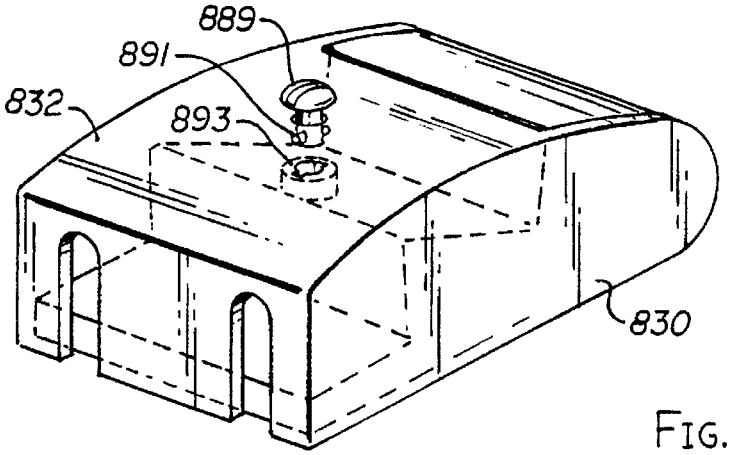
FIG. 8 is a perspective view of yet another preferred embodiment of the cover locking mechanism of the invention having a quarter turn latch through the main plate of the cover.

Another embodiment of the outlet adapter is shown in FIG. 8 (also with the cover shown as transparent). It has a slightly different sort of quarter-turn fastener 889 retained in a hole in the cover. This fastener engages with a hole 893 in the base. When turned 90 degrees, a key end 891 of this fastener locks the cover 832 to the base shell 830. This embodiment also shows a variation of the cover, having no cord-end plate.

The embodiments discussed above have shown a hinge for connecting the base of the adapter to the cover. Other connections mechanisms can be used. For instance, the embodiment shown in FIG. 8 can have the cover 832 attach to the base 830, simply by sliding from the room direction toward the support direction. Alternatively, the cover can slide in the noseward direction, to an open position that exposes one or both of the socket surfaces to the user. A snap-fit can provisionally secure the cover to the base, with the quarter-turn latch 891 providing more permanent closure.

Although embodiments of the invention have been described above that include both a base and a cover, the base alone, without any cover, is also considered an embodiment of the invention. Any of the configurations of the base described above are considered to embody inventive subject matter.

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

For instance, there may be one, two or more socket surfaces, and each may contain one, two or more sockets. It is not required that all socket surfaces include the same number of sockets. The sockets may be staggered relative to each other, or in line. They may be two or three prong, 110 or 220 volts, American standard or European standard. The cover may be latched against child tampering by any suitable means, or it may be free of a child-proof latch. It may be oriented vertically on a vertical wall, with the nose end upward and the cord end downward. Alternatively, it may be located on a horizontal surface. The orientation icons may be tactilely recognizable, visually recognizable, or both. The base and cover are typically of a molded plastic. Other configurations of conductors may be used. The cover need not be hinged or slidable as shown. What is required is that the cover can be easily moved from a closed configuration to an open configuration. The mechanism can include a living hinge, a hook and loop, a sliding cover or a completely removable cover, with a snap-fit or other suitable closure.

Having described the invention, what is claimed is:

1. An electrical outlet adapter comprising:

a) a base, comprising:

i) a shell comprising:

A) a support face comprising a substantially planar annular perimeter, having:

I) a cord end;

II) an oppositely disposed nose end; and

III) two sides, each connecting said cord end to said nose end;

B) a room face, spaced away from said support face and generally coextensive therewith, comprising:

I) a cord end socket surface and a nose end socket surface, spaced from each other and substantially parallel, each socket surface having a room edge and a support edge and forming an angle with said support face of between 90° and 135° as measured from the cord end of said support face;

II) a medial surface that connects the room edge of said cord end socket surface with the support edge of an adjacent socket surface relatively noseward; and III) piercing each said socket surface, at least one set of socket holes adapted to receive a multi-prong electrical power plug;

C) a first side that joins said room face to a first side of said support face; and D) a second side that joins said room face to the second side of said support face;

ii) adjacent each set of socket holes, between said socket holes and said support face, an electrical conductor configured to mate with said multi-prong electrical power plug when inserted into said set of holes; and iii) connected to each said electrical conductor, an electrical network that extends beyond said support face away from said room face and is configured as a multi-prong electrical power plug;

b) a cover comprising:

i) a main plate that extends over an area substantially at least as large as said medial surface of said base, said main plate comprising:

A) a cord end;

B) a nose end; and

C) two side edges, each connecting said cord end to said nose end; and ii) means for attaching said main plate to said base, movably between a closed position and an open position, wherein in said closed position, an opening is defined between said cord end of said cover and said shell to accommodate the passage of electrical cords therethrough.

2. The adapter of claim 1, said cover comprising a pair of oppositely disposed side plates, each extending substantially from said cord end to said nose end of said main plate and attached to a side edge thereof, each sized and arranged to substantially cover a respective shell side when said cover is in said closed position.

3. The adapter of claim 1, said cover further comprising a cord end plate, attached to said main plate at said cord end, sized and arranged to generally close off said opening between said cord end of said cover and said shell, except for an opening sized to accommodate the passage of at least one electrical cord therethrough.

4. The adapter of claim 1, said room face of said shell further comprising a cord end surface that connects said support edge of said cord end socket surface to said cord end of said support face.

5. The adapter of claim 1, said medial surface carrying thereon, adjacent at least one of said sets of socket holes, an indicia of the orientation of said socket holes.

6. The adapter of claim 5, said indicia being visibly perceptible.

7. The adapter of claim 5, said indicia being tactilely perceptible.

8. The adapter of claim 1, at least one of said sets of socket holes being adapted to accommodate a two pronged electrical plug.

9. The adapter of claim 1, at least one of said sets of socket holes being adapted to accommodate a three pronged electrical plug.

10. The adapter of claim 1, a set of socket holes carried by said nose end socket surface and a set of socket holes carried by said cord end socket surface being collinear with a line perpendicular to both said cord end and said nose end of said support face.

11. The adapter of claim 1, none of said sets of socket holes carried by said nose end socket surface being collinear with a line perpendicular to both said cord end and said nose end of said support face and any of said sets of socket holes carried by said cord end socket surface.

12. The adapter of claim 1, further comprising means for releasably securing said adapter to a wall outlet.

13. The adapter of claim 3, further comprising means for releasably latching said cover in said closed position relative to said base.

14. The adapter of claim 13, said means for releasably latching said cover in a closed position comprising a latch that engages between said cord end of said main plate and said cord end of said base.

15. The adapter of claim 14, said latch comprising a tab extending from said cord end of said room face of said base toward said cover and a cooperating tab recess in said cover cord end plate.

16. The adapter of claim 14, said latch comprising a slotted tab extending from said cord end of said room face of said base toward said cover and a cooperating quarter-turn fastener head and key carried by said cover cord end plate.

17. The adapter of claim 1, said means for releasably latching said cover in a closed position comprising a latch that engages between a central region of said main plate and a medial region of said room face of said base.

18. The adapter of claim 17, said latch comprising a quarter turn latch.

19. The adapter of claim 2, said side cover plates extending as far as said nose end of said base support face, said cover side plates each bearing a hinge stub and said sides of said shell each bearing a hinge hole located to cooperate with said respective hinge stub to form a hinge.

20. The adapter of claim 2, said side cover plates extending as far as said nose end of said base support face, said cover side plates each bearing a hinge hole and said sides of said shell each bearing a hinge stub located to cooperate with said respective hinge hole to form a hinge.

21. The adapter of claim 2, said side cover plates extending as far as said nose end of said base support face, said means for securing said cover in an open position comprising an opening-position protrusion carried in each side cover plate and a closure recess carried in each side of said shell, said opening protrusions and closure recesses arranged to coincide when said cover is in a closed position, and said opening protrusions sized to frictionally and releasably secure said cover in at least one open position.

22. The adapter of claim 1, said sockets of said nose-ward socket surface consisting of two prong sockets.

23. The adapter of claim 3, said means for releasably latching said cover in a closed position comprising a permanently captured quarter-turn fastener.

24. An electrical outlet adapter comprising:

a) a shell comprising:

i) a support face comprising a substantially planar annular perimeter, having:

A) a cord end;

B) an oppositely disposed nose end; and

C) two sides, each connecting said cord end to said nose end;

ii) a room face, spaced away from said support face and generally coextensive therewith, comprising:

A) at least a cord end socket surface and a nose end socket surface, spaced from each other and substantially parallel, each socket surface having a room edge and a support edge and forming an angle with said support face of between 90° and 135° as measured from the cord end of said support face;

B) a medial surface that connects the room edge of said cord end socket surface with the support edge of an adjacent socket surface relatively noseward; and C) piercing each said socket surface, at least one set of socket holes adapted to receive a multi-prong electrical power plug;

iii) a first side that joins said room face to a first side of said support face; and iv) a second side that joins said room face to the second side of said support face;

b) adjacent each set of socket holes, between said socket holes and said support face, an electrical conductor configured to mate with said multi-prong electrical power plug when inserted into said set of holes; and c) connected to each said electrical conductor, an electrical network that extends beyond said support face away from said room face and is configured as a multi-prong electrical power plug.

* * * * *